US005159152A

United States Patent [19]

Pujols

[11] Patent Number: 5,159,152

[45] Date of Patent: Oct. 27, 1992

[54] PYROTECHNIC DEVICE FOR PRODUCING MATERIAL JETS AT VERY HIGH SPEEDS AND MULTIPLE PERFORATION INSTALLATION

[75] Inventor: Christian Pujols, Merignac, France

[73] Assignee: Commissariat a l'Energie Atomique, Paris, France

[21] Appl. No.: 758,585

[22] Filed: Sep. 12, 1991

[30] Foreign Application Priority Data

Sep. 26, 1990 [FR] France ..... 90 11864

[51] Int. Cl.[5] ..... F42B 1/028

[52] U.S. Cl. ..... 102/306; 102/307; 102/701

[58] Field of Search ..... 102/701, 276, 275, 492, 102/493, 305, 306, 307, 309, 310

[56] References Cited

U.S. PATENT DOCUMENTS

| | | | |
|---|---|---|---|
| 3,224,368 | 12/1965 | House | 102/306 |
| 3,447,463 | 6/1969 | Lavine | 102/492 |
| 3,477,372 | 11/1969 | McFerrin et al. | 102/307 |
| 3,477,463 | 6/1969 | Lavine | 102/492 |
| 3,802,342 | 4/1974 | Berlot et al. | 102/701 |
| 3,998,162 | 12/1976 | Forrest et al. | 102/701 |
| 4,297,946 | 11/1981 | Daton et al. | 102/307 |
| 4,510,870 | 4/1985 | Walters | 102/309 |
| 4,753,170 | 6/1988 | Regalbuto et al. | 102/305 |
| 4,784,062 | 11/1988 | Rudolf et al. | 102/306 |
| 4,841,864 | 6/1989 | Grace | 102/307 |
| 4,862,804 | 9/1989 | Chawla et al. | 102/307 |
| 4,942,819 | 7/1990 | Thoma et al. | 102/701 |
| 4,982,665 | 1/1991 | Sewell et al. | 102/306 |
| 4,982,667 | 1/1991 | Weimann | 102/701 |

FOREIGN PATENT DOCUMENTS

| | | |
|---|---|---|
| 2724036 | 5/1977 | Fed. Rep. of Germany . |
| 1068609 | 6/1954 | France . |
| 1602622 | 2/1971 | France . |
| 660285 | 11/1951 | United Kingdom . |

*Primary Examiner*—David H. Brown

*Attorney, Agent, or Firm*—Oblon, Spivak, McClelland, Maier & Neustadt

[57] ABSTRACT

The invention makes it possible to produce a large number of jets of material at very high speeds from different surfaces. The device essentially comprises a detonator initiating an explosive charge by causing a detonation shock wave, which leaves the explosive charge in order to simultaneously initiate all the points of the entrance surface of a projectile. A cavity is made in the projectile in order to bring about the formation of a filiform jet in accordance with the vertical axis during the ejection of the projectile. An intermediate projectile can be provided between the explosive charge and the projectile. Different shapes of cavities and projectiles makes it possible to modulate the production of the jets as a function of the form and nature of the targets to be reached. Application is possible of the invention to making openings and to dismantling of various structures, to oil drilling operations and to geothermics.

13 Claims, 4 Drawing Sheets

PYROTECHNIC DEVICE FOR PRODUCING MATERIAL JETS AT VERY HIGH SPEEDS AND MULTIPLE PERFORATION INSTALLATION

DESCRIPTION

1. FIELD OF THE INVENTION

The invention relates to the cutting up or disintegration of various solid structures, such as metals and rocks, said structures being fixed or mobile. The main applications are the study of phenomena in connection with the formation of craters in different materials, intense current ultrafast switches, oil well installations, geothermics and the exploitation of sources. In all these fields, it is necessary to have tools able to perforate any random material in a precise manner or project the material at speeds of several kilometers per second.

2. PRIOR ART

Various hollow charge devices are known which are able to project a jet of material in the plastic state at speeds of about 10 km/s. These hollow charge devices are used in the following fields:

- the perforation and fragmentation of rocks;
- the perforation and dismantling of various structures;
- the piercing of armor-plating in armor-plated military vehicles;
- the ultrafast switching of intense currents.

With reference to FIG. 1, a hollow charge device essentially comprises a confinement envelope 2 within which is placed an explosive charge 4. A detonator 6 completed by a relay 8 is provided for initiating the explosion of the charge 4. The projected material is initially constituted by a conical metal coating 10 placed against a corresponding conical recess of the explosive charge 4. The base 12 of the cone of the metal coating 10 is positioned facing a large orifice in the confinement envelope 2. The explosion of the charge 4 by means of the detonator 6 and the relay 8 takes place by the propagation of a detonation shock wave across the entire explosive charge 4 until it reaches the metal coating 10. The top 14 of the cone of the metal coating 10 is consequently reached prior to the base 12. There is then a concentration of metal in the plastic state on the longitudinal axis 15 of the hollow charge, starting at the apex or tip 14 and then progressing towards the base of the coating. The thus formed material jet is ejected at speeds of several km/sec.

The perforating capacity of such a hollow charge device in part increases with the density of the projected metal coating 10. This only applies in connection with metals having specific weights below 10 g/cm$^3$. For example, in the case of tantalum this does not apply beyond this figure, in view of the very high melting point of this metal. Thus, there is then a jet fragmentation phenomenon, which is prejudicial to its drawing out.

It should also be noted that the top speed of the projected metal jet increases in inverse proportion to the angle of inclination A of the metal coating cone 10. However, it is not possible to excessively reduce this inclination angle A of the cone, because then the jet bursts. Thus, it has been found in the case of copper, that the maximum projection speed for a coherent jet, i.e. a filiform jet, does not exceed 10 km/s.

Within the framework of the study of the behavior of certain materials with respect to the formation of craters as a result of impact, pyrotechnic devices are used for projecting materials at a speed higher than 10 km/s.

Reference can be made to the article by A. B. WENZEL: "A Review of Explosive Accelerators for Hypervelocity Impact" HYPERVELOCITY IMPACT-Proceeding of the 1986 symposium—San Antonio, Tex., 21-24 October 1986. These devices derived from conventional hollow charges are limited with regards to the projection speed to 15 km/s for aluminium and 12 km/s for nickel or steel.

The aim of the invention is to provide similar devices able to project materials at more than 20 km/s in the form of one or more coherent jets and be usable in various applications.

SUMMARY OF THE INVENTION

A first objective of the invention is to provide a pyrotechnic device for producing jets of material at very high speeds of the type comprising at least one assembly constituted by a projectile obtained from a part having a constant thickness and an explosive charge for causing a shock wave in the projectile and eject it in the form of a jet of material, via a wave exit surface positioned so as to correspond with a wave entrance into the projectile and a detonating device for initiating the explosion charge by one or more primary points.

According to the invention, the projectile comprises at least one cavity in its outer surface, opposite to the shock wave entrance surface into the projectile so as to constitute a relative projectile thickness reduction, so that the latter is ejected at a very high velocity at each cavity, in the form of a material jet.

The different cavity shapes make it possible to obtain different types of jets able to exceed a speed of 20 km/s. The cavities, where they have a flat bottom, can be cylindrical truncated cone shaped or prismatic, but issue on to the outer surface of the projectile. They are advantageously completed in this case by a rounded portion at the bottom of the cavity. When they are cylindrical, the cavities can pass through the entire thickness of the projectile, in order to issue on to the entrance face of the wave into the projectile. The cavities can also be concave or convex hemispherical.

According to a special feature of the invention, use is made of an intermediate projectile in which the exit surface of the wave from the explosive charge is faced by an intermediate wave entrance surface and the projectile wave entrance surface is faced by an intermediate surface. This intermediate projectile serves as a relay.

When priming takes place by a single priming point, it is possible to provide spherical exit surfaces for the wave from the explosive charge, the center of the sphere being the priming point.

When there are several priming points positioned along a priming axis, the exit surface of the wave from the explosive charge is cylindrical, the axis of the cylinder being the priming axis.

When the priming points are distributed over a priming plane, via a plane wave detonating generator, the exit surface of the wave from the explosive charge is planar and parallel to the priming plane.

When the priming of the detonation takes place on a cylindrical surface, the exit surface of the wave from the explosive charge is cylindrical and coaxial to the priming cylinder. In this case a plurality of cavities are placed on the outer cylindrical wall of the projectile.

This latter construction can give rise to a multiple perforation installation incorporating several pyrotechnic devices connected by a firing cable initiating the detonator of each device. Such an installation can be used in drilling oil wells and in geothermics.

The invention and its technical characteristics will be better understood from reading the following description.

BRIEF DESCRIPTION OF THE DRAWINGS

The following description is accompanied by several drawings, wherein show.

DETAILED DESCRIPTION OF THE PREFERRED EMBODIMENTS OF THE INVENTION

Figure 2A:
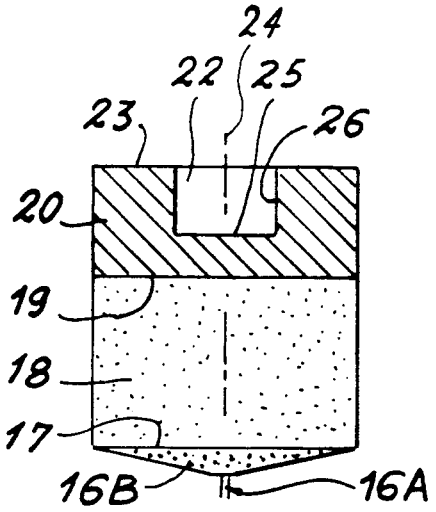
FIGS. 2A, 2B and 2C show three diagrams relating to a first construction of the device according to the invention, in which the shock wave is planar.
Figure 2B:
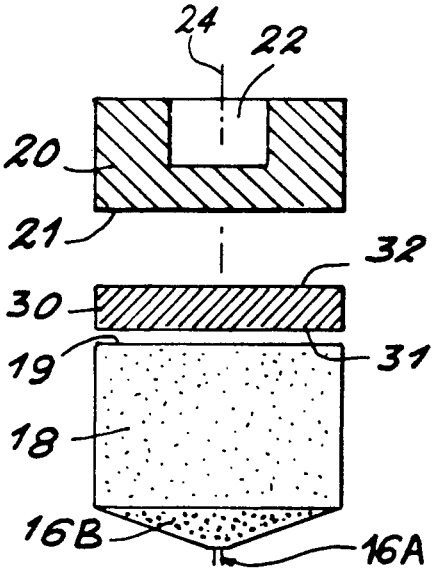
Figure 2C:
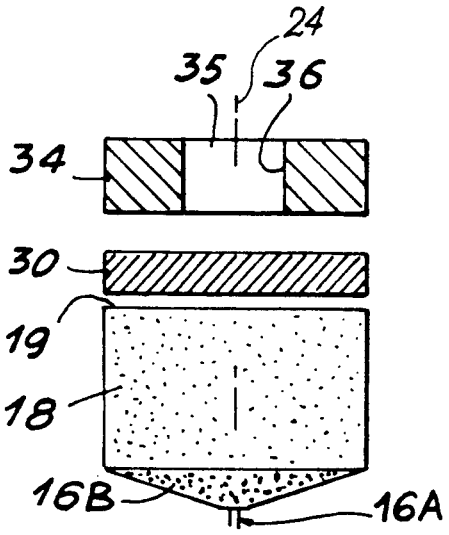

With reference to FIGS. 2A, 2B and 2C, the pyrotechnic device according to the invention essentially comprises a detonator 16A for initiating, a plane wave detonating generator 16B in contact with an explosive charge 18 by a rear surface 17 of the latter. A third important element of the device is the projectile 20, which is the member ejected at high speed by the explosive charge 18. By an entrance surface of the wave 21, the projectile 20 faces an exit surface of a wave 19 from the explosive charge 18 and is opposite to the contact surface 17 with the plane wave generator, the projectile being a part having a constant thickness.

The detonator 16A transmits the detonation wave to the explosive charge 18, either by initiating the latter at a single point or, as shown in FIGS. 2A, 2B and 2C, by initiating the explosive charge over the entire contact surface 17 by a plane wave detonating generator 16B. The shock wave then transmitted into the explosive charge 18 is propagated uniformly therein. It reaches the exit surface of the wave 19 in a uniform manner, i.e. all the points of the exit surface of the wave 19 receive the shock wave at the same time. Therefore all the points of the entrance surface of the wave 21 from the projectile 20 receive the shock wave at the same time.

Figure 1:
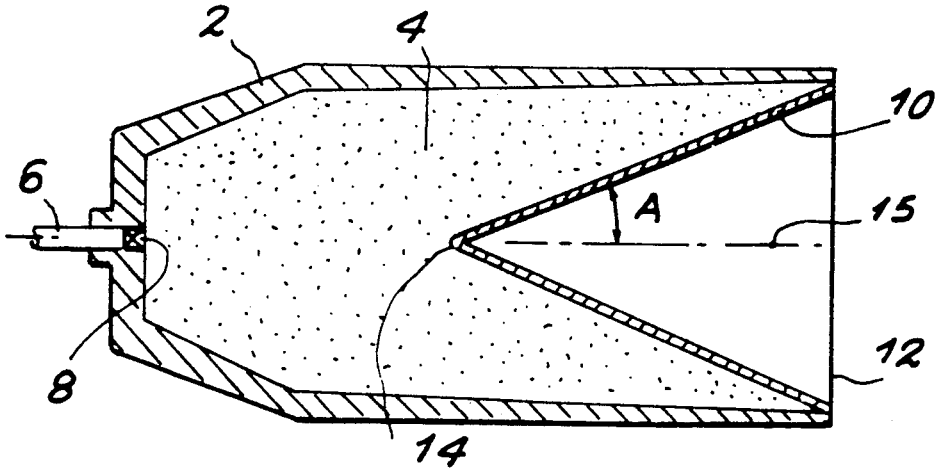
FIG. 1 PRIOR ART
FIG. 1, already described, shows a diagram relating to a prior art hollow charge device.
Figure 4A:
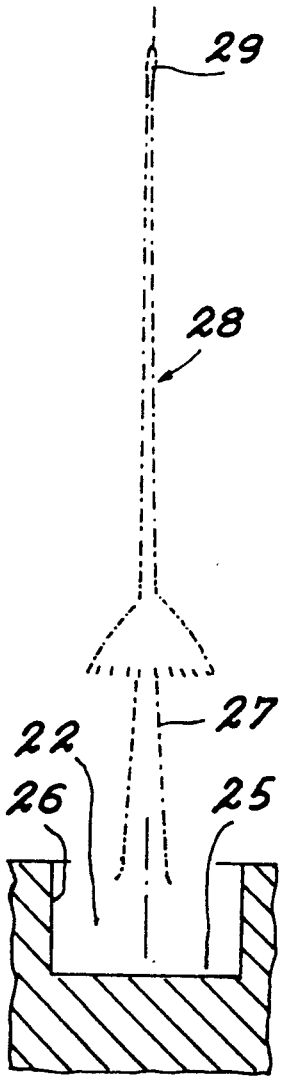
FIGS. 4A, 4B and 4C are diagrams illustrating the results obtained with the devices according to the invention.
Figure 4B:
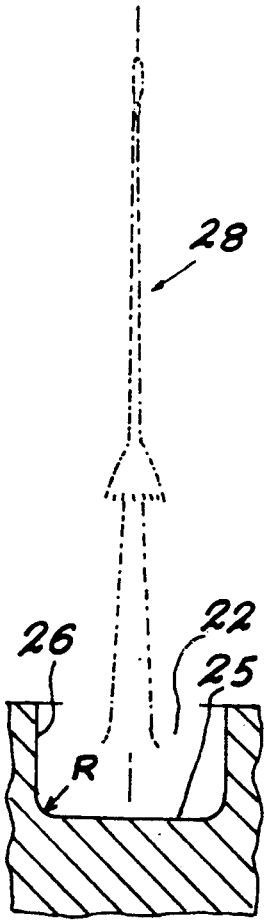
Figure 4C:
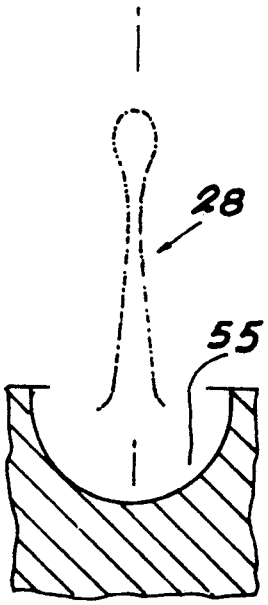

According to the invention, the material jets projected at very high velocities are created by the presence of cavities 22 in the projectile. The formation of a jet in the axis of the hole 20 is due to the combination of two events, namely the propulsion of material from the bottom of the hole 22 or the walls of the cavity 35 at very high speed (several km/sec) and quasi-simultaneous implosion, also at very high speed (several km/sec) of the sidewall 26 or 36 of the hole 22 or cavity 35. It is the thickness reduction of the part forming the projectile 20 which leads to the formation of a jet projected at a very high speed and not the general shape of the projectile, as is the case with hollow charges. This phenomenon is illustrated by FIGS. 4A, 4B and 4C.

On returning to FIGS. 2A, 2B and 2C several constructions are possible with cavities having a cylindrical shape.

FIG. 2A shows a cylindrical cavity 22 located on the outer surface 23 of the projectile 20 and having a bottom 25, maintaining a metal thickness between said bottom 25 and the shock wave generated by the explosive charge 18.

FIG. 2B shows a construction using an identical projectile 20. It can be made from a different material than that of projectile 20. However, an intermediate projectile 30 is interposed between projectile 20 and the explosive charge 18. It has an entrance surface for the wave 31 located facing the exit surface for the wave 31 from the explosive charge. These two surfaces can be in contact with one another or separated by a small gap, as shown in FIG. 2B. The intermediate projectile 30 has an exit surface for the wave 32, which is preferably parallel to the entrance surface for the wave 31 and positioned facing the entrance surface for the wave 21 in the projectile 20. The effectiveness of such a device is optimum when a space is maintained between the projectile 20 and the intermediate projectile 30.

FIG. 2C shows a device making use of the operating principle of the device of FIG. 2B with an intermediate projectile 30. However, the main projectile 34 has a cavity 35 completely traversing the projectile 34. Thus, the cavity is only defined by its sidewalls 36. The projectile 34 and the intermediate projectile 30 can be of a different nature. In this case, the new face of the projectile 24 in contact with the charge 18 must be perpendicular to the axis of the cavity 22 and parallel to the front of the plane detonation wave.

Figure 3A:
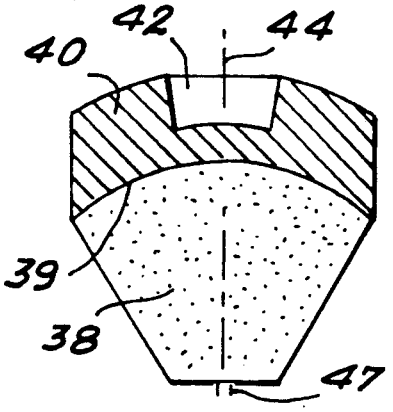
FIGS. 3A and 3B are diagrams relating to a second embodiment of the device according to the invention, in which the shock wave is spherical or cylindrical.
Figure 3B:
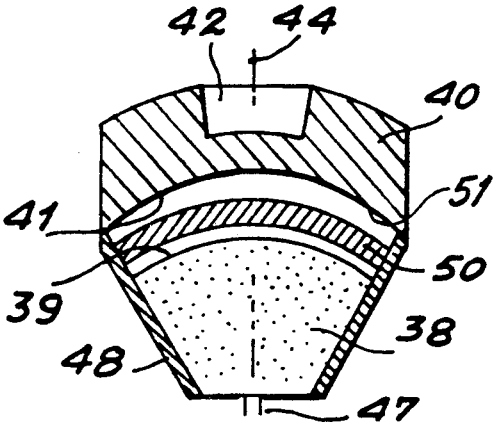

A second type of device according to the invention adopts the principles of the devices described relative to FIGS. 2A and 2B and is shown in FIGS. 3A and 3B. As can be seen, the main difference is the shape of the explosive charge 38 and the main projectile 40 and the shape of the intermediate projectile 50. Thus, in FIG. 3A, the contact surface 39 between the explosive charge 38 and the projectile 40 is either spherical, or cylindrical. More specifically, the exit surface for the wave 39 from the explosive charge 38 and the entrance surface of the wave 41 from the projectile 40 have corresponding shapes, which are either spherical, or cylindrical. In the first cases, the priming of the explosive charge 38 takes place in a quasi-punctiform manner by a detonator 47 located in the center of the base of the explosive charge 38. Thus, the shock wave is propagated in the explosive charge in a symmetrical manner with respect to the axis 44 around the priming point. If the contact surfaces between the projectile 40 and the explosive charge 38 are cylindrical, the priming of the explosive charge 38 takes place by a series of detonators 47 located on the axis of the cylinder of the contact surfaces perpendicular to the vertical axis 44. It is more simply possible to also use a cylindrical detonating wave generator.

In the two cases of FIG. 3A, the shock wave arrives simultaneously at all points of the exit surface of the wave 39 from the explosive charge 38 in order to penetrate all points of the entrance surface of the wave 41 from the projectile 40.

On referring to FIG. 3B, the shapes of FIG. 3A are used on a device of the type described relative to FIG. 2B, i.e. an intermediate projectile 50 is placed between the main projectile 40 and the explosive charge 38. These shapes are either spherical, or cylindrical, but other shapes for the projectiles 40 and 50 can be used, provided that they are symmetrical with respect to the axis of the cavity 44. This intermediate projectile obviously has a wave entrance surface 51 and a wave exit surface with a shape corresponding to the corresponding surfaces 39 and 41 of the explosive charge 38 and the main projectile 40. These shapes are spherical or cylindrical. However, other shapes "axially symmetrical" to the axis 44 of the hole 42 can be given to the intermediate projectiles 50 and to the impact face of the projectile 40 when there is a single emissive cavity in the projectile 40. The charge detonation wave can then diverge or converge in the explosive and generate a divergent or convergent shock to the projectile around the cavity.

It is even possible to envisage a cavity 35 passing completely through the main projectile 40, as in FIG. 2C. In both these cases, the explosive charge 38 can be surrounded by walls 48, which form a frustum-shaped enclosure in the case where the propagation of the wave is spherical, or which forms a trapezoidal enclosure in the case where the propagation of the wave is cylindrical, centered around an axis on which are aligned the detonators 47.

It is possible to modulate the shape and velocity of the material jet by acting on the shape of the cavity from which the jet in question is emitted. Thus, by referring to FIGS. 4A, 4B and 4C, it can be seen that a completely cylindrical cavity, like that shown in FIG. 4A, produces an ultrafast filiform jet. A large distance separates the head 29 from the base 27 of the jet 28. The material used can be copper or the aluminium alloy AU4G. In this case, the cavity has a diameter and height of 20 mm.

FIG. 4B shows an identical cavity, but whose bottom 25 is connected to the sidewalls 26 with the aid of a rounded portion R. In this case, the jet 28 is slightly less fast.

FIG. 4C shows the use of a hemispherical cavity 55. In this case, the ejected copper jet 28 is even less fast, but has a larger diameter than in the two previous cases.

In general terms, for cavities having a depth of 20 mm, the projectile 20 must have a thickness of approximately 30 mm, in the case where the cavities do not issue on to the entrance surface of the wave 21. In this case, the top speed of the jet with a copper projectile exceeds 20 km/s and can reach 24 km/s for alloy AU4G. The projected metal jets can have a diameter of 0.8 mm at the jet head 29 and 2 to 3 mm at the jet base 27.

In the same way as the dimensions, shape of the cavities and nature of the materials used influence the velocity and length of the jets, an influence is also exerted by the intensity of the shock wave transmitted in the projectile parts. The higher the intensity of the shock, the higher the velocity of the jet.

It should also be noted that the depth of each cavity also increases the velocity of the jet until said depth reaches approximately the diameter of the cavity. Beyond this, any depth increase will only slightly increase the speed of the jet. It should also be noted that the volume of material ejected in the jet increases with the volume of the cavity made in the projectile.

The hitherto described embodiments have related to metal projectiles. Other solid materials can also be used and in particular refractory materials, ceramics, glasses, carbons and composite materials.

In the case where it is wished to produce jets having various shapes or multiple jets, with a view to obtaining various cutout shapes on the targets, it is possible to program the spacing and shape of the cavities issuing into the projectile in the same way as their depth. It is even possible to form interpenetrations of cavities with respect to one another and to create cavities in the form of a continuous recess in the projectile. All these shapes can also be applied to spherical or cylindrical projectiles by using concentric shock waves.

With the device according to the invention, it is possible to modify the shape and the bottom of the cavity so as to modify the length of the jet. It is therefore possible to shorten the impact distance of the jet in order to create at a precise point a shock wave having a pressure and duration just sufficient to bring about a punctiform priming of an explosive without any subsequent deterioration due to the jet. Thus, by extending in an exaggerated manner the depth of the cavities, it is possible to obtain small ultrafast jets of very short lengths, obtained as a result of a self-sealing of the hole during the formation of the jet.

The devices according to the invention can be used in drilling oil wells or in geothermics. Thus, for multiple perforations through rock, it is possible to extract the oil or any other fluid sought in the subsoil.

Figure 5:
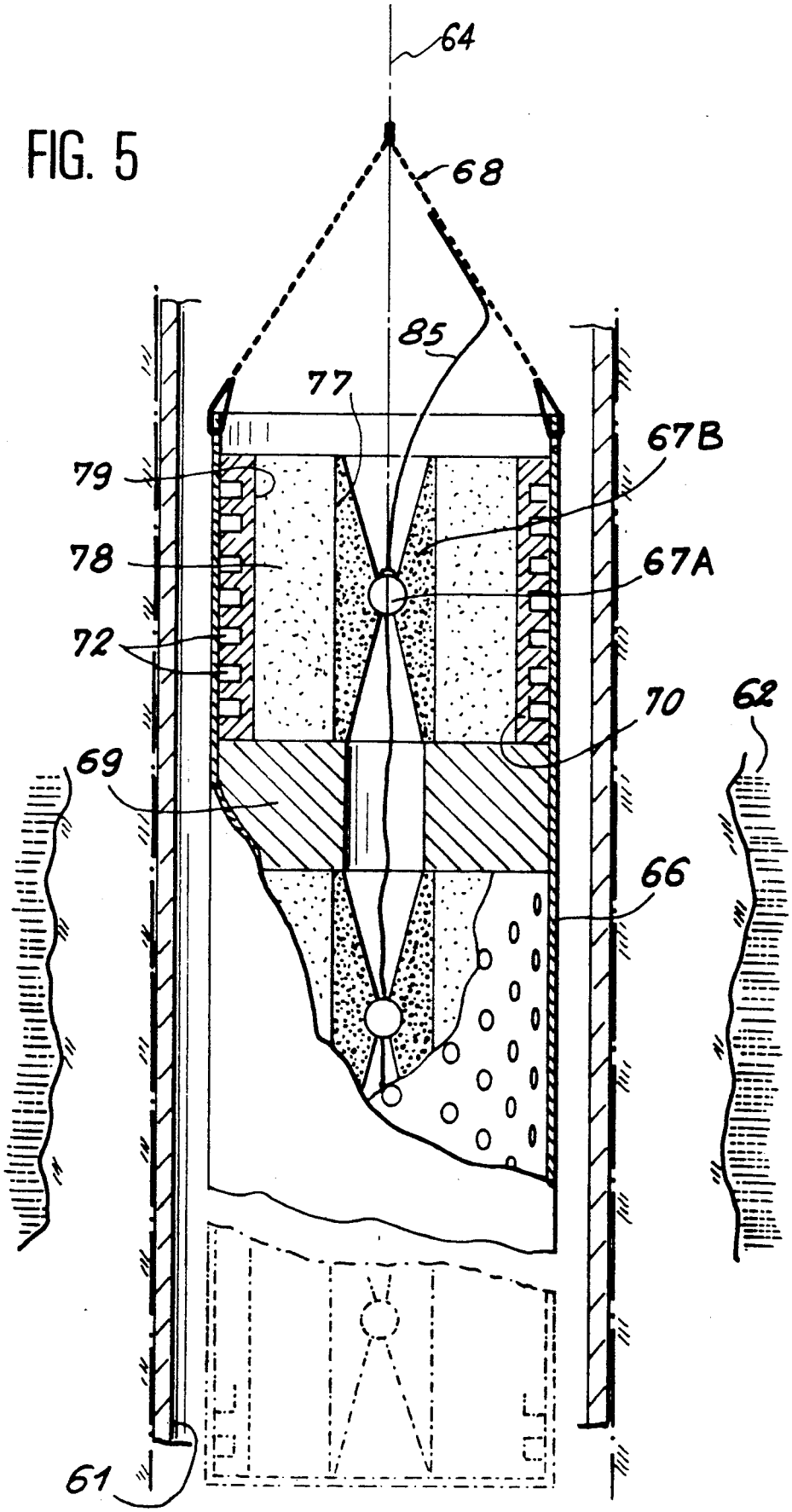
FIGS. 5 and 6 are diagrams relating to applications of the device according to the invention to drilling installations used in the petroleum production industry and geothermics.

With reference to FIG. 5, such an installation has been shown in an oil well 60 or any other underground vertical pipe made in the subsoil. In a dark area to the side of the drawing can be seen two oil or other liquid pockets 62 to be extracted.

The installation of FIG. 5 incorporates an assembly of various pyrotechnic devices of the cylindrical surface projectile type, as shown in FIG. 3A, the axis of the cylinder being the vertical axis 64 on which are placed the detonators. The installation is confined in an envelope 66 suspended on a lowering cable 68 and within which are located the pyrotechnic devices. The outer part of the latter is constituted by projectiles combined for each device in a cylindrical projectile part 70 on which are made a plurality of jet generating cavities 72. The latter are oriented perpendicular to the vertical axis 64 of the installation, in the direction of the vertical walls 61 of the well 60 into which the installation is lowered. Each device is initiated by a detonator 67A, which generates via a cylindrical wave detonating generator 67B a cylindrical wave in the entrance surface of the wave 77 from the explosive charge 78. A cylindrical shock wave is then produced in the projectile 70 by contact of the exit surface of the wave from the explosive charge with the entrance surface of the wave from the projectile, both being designated by reference number 79. Each detonator 67A is connected to the control device by a firing cable 85, which simultaneously triggers all the pyrotechnic devices. Such a cylindrical shape of the pyrotechnic devices makes it possible to act on underground cavities in a symmetrical manner.

FIG. 5 shows two pyrotechnic devices, separated by a spacer 69, but a larger number of devices can be assembled in a single installation.

Figure 6:
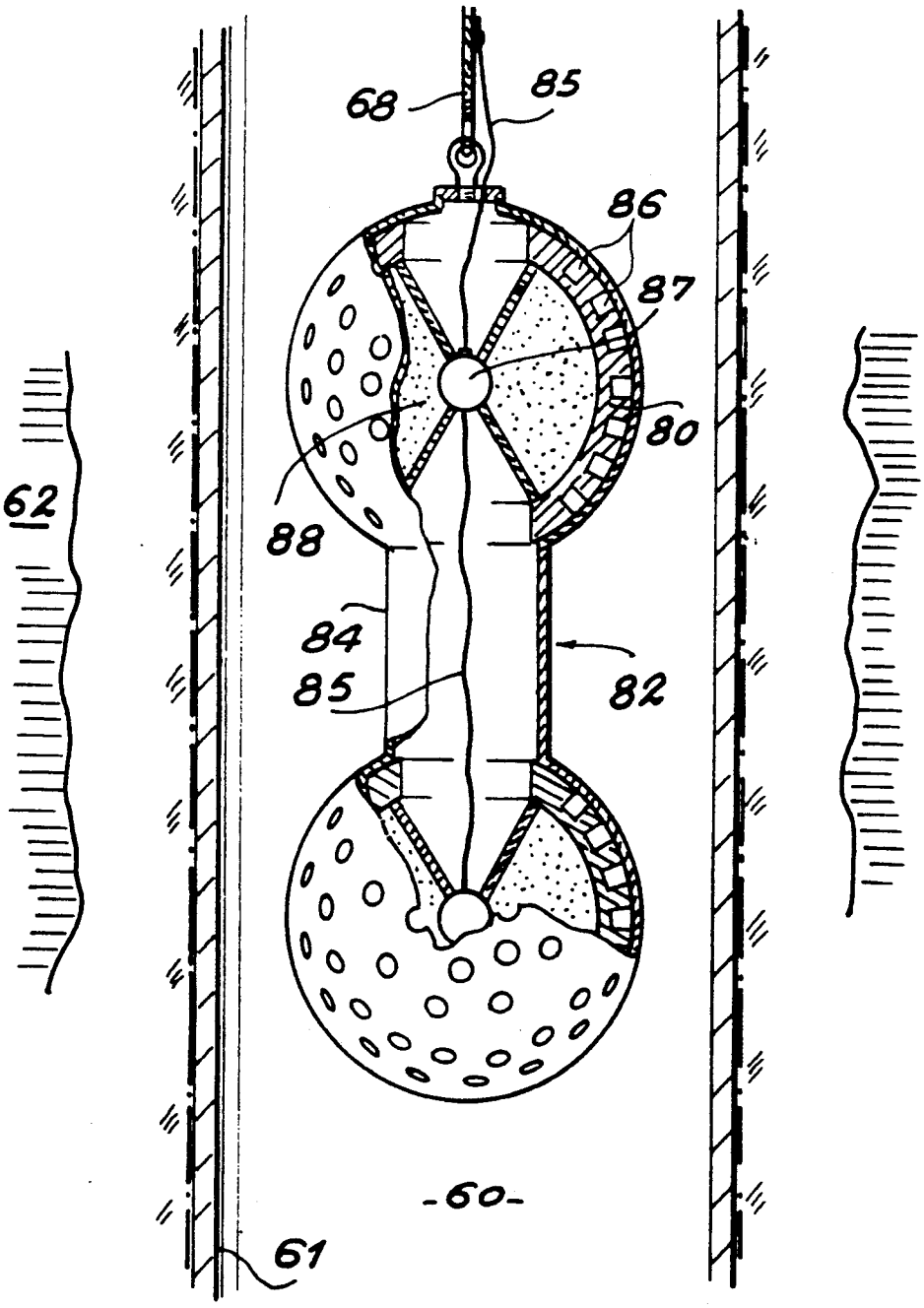

With reference to FIG. 6 and in a similar manner to FIG. 5, a second type of installation can be produced with two pyrotechnic devices using projectiles having a spherical outer surface. On referring to FIG. 3A, the detonation wave is in this case spherical, i.e. the detonator 87 initiates the explosive charge at a single point.

It is possible to see a lifting cable 68, a firing cable 85, and an enclosure 82 adopting the shape of the two spheres and connected by a cylinder 84. The two spheres in each cases receive a spherical pyrotechnic device, which comprises a plurality of projectiles joined in the form of a spherical cup 80, in which are formed a plurality of cavities 86 issuing on to the outer envelope 82. In the interior is located the explosive charge 88 having a detonator 87 in its center. The two detonators 87 or a detonator-relay system, depending on the sensitivity of the explosive 78 to be primed, of the two devices are connected by the firing cable 85. In this case the shock wave is spherical and concentric to the projectile means 80. In the latter case, a plurality of spherical pyrotechnic devices can be provided within a single well.

In these two applications, it is possible to use an intermediate projectile between the explosive charge and the cavities.

These embodiments are not limitative and other pyrotechnic charge shapes and forms can be conceived in accordance with the principle of producing a plurality of jets with the aid of cavities made in a projectile part and subject to the action of an intense shock wave.

As a function of the distance to be drilled into the rock or the well wall, it is possible to modulate the number of metal jets which can be simultaneously emitted. The volume of each cavity is also to be a function of the impact to be obtained. In general terms, the density of jets emitted per surface unit is in inverse proportion to the desired depth.

The detonators can be of a detonating fuse type, supplemented by a relay.

Copper has been referred to as the metal used for the projectile. However, it is possible to use steel, lead alloys, tantalum and other metals.

I claim:

1. Pyrotechnic device for producing very high velocity material jets of the type comprising:

at least one assembly constituted by a projectile obtained from a piece of material having a substantially constant thickness, and means for launching the projectile in order to eject the projectile in the form of material jets via an exit surface of a detonation shock wave from an explosive charge positioned so as to correspond with an entrance surface of the wave into the projectile, wherein the projectile has at least one cavity in an outer surface thereof opposite to an entrance surface of the wave from the projectile so as to produce a reduction of the thickness of the projectile, in order that the latter is ejected at a very high velocity at each cavity in the form of a material jet.

2. Device according to claim 1, wherein the at least one cavity is hemispherical.

3. Device according to claim 1, which comprises a plurality of detonators aligned on a priming axis, wherein the exit surface of the wave from the explosive charge comprises a cylinder of revolution about the priming axis.

4. Device according to claim 1, which comprises an intermediate projectile where the exit surface of the wave from the explosive charge is faced by an intermediate entrance surface of the wave and the entrance surface of the wave from the projectile is faced by an intermediate exit surface of the wave.

5. Device according to claim 4, wherein all the points of the exit surface of the wave from the explosive charge or of the intermediate projectile are equidistant of the priming point or points, so that the shock wave exits at the same time from the explosive charge or the intermediate projectile at all the points of the exit surface of the wave.

6. Device according to claim 1, wherein the at least one cavity is partly cylindrical and issue on to the outer surface of the projectile opposite to the entrance surface of the wave.

7. Device according to claim 6, wherein the at least one cavity has a rounded portion between the bottom and sidewalls of each cavity.

8. Device according to claim 6, wherein each cylindrical cavity traverses the projectile in order to issue on to the entrance face of the wave from the projectile.

9. Device according to claim 1, wherein said projectile launching means comprises an explosive charge for producing a shock wave in the projectile and a detonator for initiating the explosion of the explosive charge by at least one priming point.

10. Device according to claim 9, wherein said detenation shock wave comprises a cylindrical wave detonating generator.

11. Device according to claim 9, wherein the detonator is of the plane wave detonating type, the exit surface of the wave from the explosive charge being planar and parallel to a priming plane.

12. Device according to claim 9, wherein the detonator comprises means for producing a single priming point, the exit surface of the wave from the explosive charge being spherical, and the center of the sphere being the priming point.

13. Device according to claim 12, wherein said at least one assembly comprises a plurality of assemblies connected by a firing cable initiating a detonator of each assembly.

* * * * *